US008721016B2

(12) United States Patent
Kim et al.

(10) Patent No.: US 8,721,016 B2
(45) Date of Patent: May 13, 2014

(54) APPARATUS FOR AND METHOD OF DRIVING MULTI-NOZZLE PIEZO-INKJET HEAD BASED ON DIGITAL GRAYSCALE

(75) Inventors: Byung Hun Kim, Gyunggi-do (KR); Hwa Sun Lee, Gyunggi-do (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 55 days.

(21) Appl. No.: 13/611,186

(22) Filed: Sep. 12, 2012

(65) Prior Publication Data

US 2014/0002521 A1 Jan. 2, 2014

(30) Foreign Application Priority Data

Jun. 28, 2012 (KR) ..... 10-2012-0070360

(51) Int. Cl.
*B41J 29/38* (2006.01)

(52) U.S. Cl.
USPC ..... 347/9; 347/10

(58) Field of Classification Search
USPC ..... 347/5, 9, 10, 12, 13, 40, 42
See application file for complete search history.

(56) References Cited

U.S. PATENT DOCUMENTS

2004/0075705 A1 4/2004 Tanaka
2008/0238964 A1* 10/2008 Umeda ..... 347/10

FOREIGN PATENT DOCUMENTS

| | | |
|---|---|---|
| JP | 09-254380 | 9/1997 |
| JP | 10-81012 | 3/1998 |
| JP | 2000-127458 | 5/2000 |
| JP | 2002-166580 | 6/2002 |
| JP | 2003-054015 | 2/2003 |
| JP | 2003-285453 | 10/2003 |
| JP | 2006-068991 | 3/2006 |
| JP | 2006-95763 | 4/2006 |
| JP | 2009-233946 | 10/2009 |

OTHER PUBLICATIONS

Japanese Office Action issued Jun. 18, 2013 in corresponding Japanese Application No. 2012-207365.
Korean Office Action issued Sep. 30, 2013, in corresponding Korean Application No. 10-2012-0070360.

* cited by examiner

*Primary Examiner* — Juanita D Jackson

(57) ABSTRACT

There is provided an apparatus for and method of driving a multi-nozzle piezo-inkjet head based on a digital grayscale, the apparatus including: a control unit providing a pulse data signal having at least one pulse waveform according to graphic image data, controlling a voltage variation according to a frequency response characteristic of the multi-nozzle piezo inkjet head, and controlling a voltage amplification, so as to eject droplets of ink at a previously set jetting frequency according to the graphic image data; a variable voltage supply unit generating a varied operating voltage by varying a level of a previously set direct current voltage; and an amplification circuit unit generating a voltage driving waveform including at least one pulse waveform having the level of the varied operating voltage, and supplying the voltage driving waveform to the multi-nozzle piezo inkjet head.

12 Claims, 6 Drawing Sheets

APPARATUS FOR AND METHOD OF DRIVING MULTI-NOZZLE PIEZO-INKJET HEAD BASED ON DIGITAL GRAYSCALE

CROSS-REFERENCE TO RELATED APPLICATIONS

This application claims the priority of Korean Patent Application No. 10-2012-0070360 filed on Jun. 28, 2012, in the Korean Intellectual Property Office, the disclosure of which is incorporated herein by reference.

BACKGROUND OF THE INVENTION

1. Field of the Invention

The present invention relates to an apparatus for and method of driving a multi-nozzle piezo-inkjet head based on a digital grayscale.

2. Description of the Related Art

In general, a piezoelectric (PZT) actuator driving type inkjet head is configured to include a pressure chamber, a nozzle, a flow path, and a piezoelectric actuator that is an actuator for generating a driving pressure. To drive such a piezoelectric actuator, a driver for generating a driving voltage waveform is required.

For example, to briefly describe a process of ejecting droplets from a multi-nozzle piezo inkjet head, when a driver generates a voltage driving waveform and provides a piezoelectric actuator therewith, since the piezoelectric actuator is generally tightly adhered to a pressure chamber, a displacement of the piezoelectric actuator occurs according to the applied voltage driving waveform. The displacement generates pressure in the pressure chamber inside the inkjet head so that droplets inside the pressure chamber are ejected to the outside thereof through the nozzle.

Generally, in the case of a piezoelectric actuator driving type inkjet head, a voltage driving waveform in a range of 30 to 200 V is required, and the number of nozzles per inkjet head is approximately 10 to 1000. Various methods may be used to drive such a multi-nozzled inkjet head.

First, a method for driving a push-pull inkjet head according to the related art will be described. A high voltage driving waveform having the same form as a data signal is applied to the piezoelectric (PZT) actuator by using a push-pull amplification circuit.

In this regard, a magnitude of the voltage driving waveform applied to the piezoelectric actuator is the same as an operating voltage Vpp, and a form thereof is the same as that of a data signal. This method is very simple in the case of a multi-nozzle head, and thus a circuit unit of a head driving unit may be simplified.

However, a factor capable of changing the voltage driving waveform is restricted, to thereby allow a speed or volume of ejected droplets to be controlled through waveform duration only.

Meanwhile, in order to eject droplets of various sizes for implementing a grayscale, several waveforms having the same voltage level are implemented, and thus, droplets having different sizes may be ejected from an inkjet head.

However, it may not be easy to precisely adjust the speed of droplets having various sizes through the duration of a waveform having the same voltage level, and unstable droplets may be generated such that droplets may not be ejected any more.

As such, when droplets having various sizes have different speeds, locations at which droplets arrive on a printing media when being printed are different, problematically deteriorating printing quality.

The following Related Art Document relates to an apparatus for and method of driving an inkjet recording head and does not disclose a technology of driving a piezoelectric actuator inkjet head based on a digital grayscale.

RELATED ART DOCUMENT

Japanese Patent Laid-Open Publication No. 2003-054015

SUMMARY OF THE INVENTION

An aspect of the present invention provides an apparatus for and method of driving a multi-nozzle piezo inkjet head based on a digital grayscale by which speed and volume of droplets are appropriately adjusted by varying a level of a voltage driving waveform according to digital data based on the digital grayscale, without increasing a slew rate of a voltage driving waveform when the multi-nozzle piezo inkjet head is driven.

According to an aspect of the present invention, there is provided an apparatus for driving a multi-nozzle piezo-inkjet head based on a digital grayscale, the apparatus including: a control unit providing a pulse data signal having at least one pulse waveform according to graphic image data, controlling a voltage variation according to a frequency response characteristic of the multi-nozzle piezo inkjet head, and controlling a voltage amplification, so as to eject droplets of ink at a previously set jetting frequency according to the graphic image data; a variable voltage supply unit generating a varied operating voltage by varying a level of a previously set direct current voltage according to the pulse data signal of the control unit; and an amplification circuit unit generating a voltage driving waveform including at least one pulse waveform having the level of the varied operating voltage according to a voltage amplification control of the control unit, and supplies the voltage driving waveform to the multi-nozzle piezo inkjet head.

The voltage driving waveform of the amplification circuit unit may include a pulse waveform having a voltage level that is amplified from the voltage level of the varied operating voltage.

The voltage driving waveform of the amplification circuit unit may include at least two pulse waveforms having different voltage levels according to the voltage level of the varied operating voltage.

The variable voltage supply unit may include: a DAC that converts the pulse data signal of the control unit into an analog voltage signal; and a power amplification unit that generates the varied operating voltage by varying the previously set direct current voltage according to the analog voltage signal of the DAC.

According to another aspect of the present invention, there is provided a method of driving a multi-nozzle piezo inkjet head based on a digital grayscale, the method including: (a) forming multi-channel image data according to an image to be printed, so as to eject droplets of ink at a previously set jetting frequency according to graphic image data; (b) previously setting a basic waveform having a plurality of pulse rows, and determining a pulse data signal having at least one pulse waveform according to the multi-channel image data for each of a plurality of nozzles of the multi-nozzle piezo inkjet head; (c) generating a varied operating voltage by varying a level of a previously set direct current voltage according to the pulse data signal according to a frequency response characteristic of the multi-nozzle piezo inkjet head; (d) generating a voltage waveform having at least one pulse waveform having a level of the varied operating voltage; (e) driving the multi-nozzle piezo inkjet head by using the voltage waveform, and measuring a speed and volume of the ejected grayscale droplets; (f) determining whether the measured speed and volume of ejected grayscale droplets are within previously set allowable ranges; (g) when the measured speed and volume of the ejected grayscale droplets are not within previously set allowable ranges, minutely adjusting the level of the varied operating voltage and proceeding to operation (d); and (h) when the measured speed and volume of the ejected grayscale droplets are within previously set allowable ranges, setting a varied operating voltage and a voltage driving waveform for respective pieces of graphic image data.

The operation (f) may include: determining whether a difference between the measured droplet speed and a target droplet speed is within a previously set allowable speed range; and determining whether a difference between the measured droplet volume and a target droplet volume is within a previously set allowable volume range.

According to another aspect of the present invention, there is provided a method of driving a multi-nozzle piezo inkjet head based on a digital grayscale, the method including: (i1) providing a pulse data signal according to graphic image data, controlling a voltage variation according to a frequency response characteristic of the multi-nozzle piezo inkjet head, and controlling a voltage amplification, so as to eject droplets of ink at a previously set jetting frequency according to the graphic image data; (i2) generating a varied operating voltage by varying a level of a previously set direct current voltage according to the pulse data signal of operation (i1); and (i3) generating a voltage driving waveform including at least one pulse waveform having a level of the varied operating voltage of the operation (i2) and supplying the voltage driving waveform to the multi-nozzle piezo inkjet head.

The voltage driving waveform of the operation (i3) may have the voltage level of the operation (i2).

The voltage driving waveform of the operation (i3) may include different voltage levels.

The jetting frequency according to the aspects of the present invention may be set to be higher than an operating frequency of the multi-nozzle piezo-inkjet head such that the jetting frequency corresponds to the grayscale.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1:
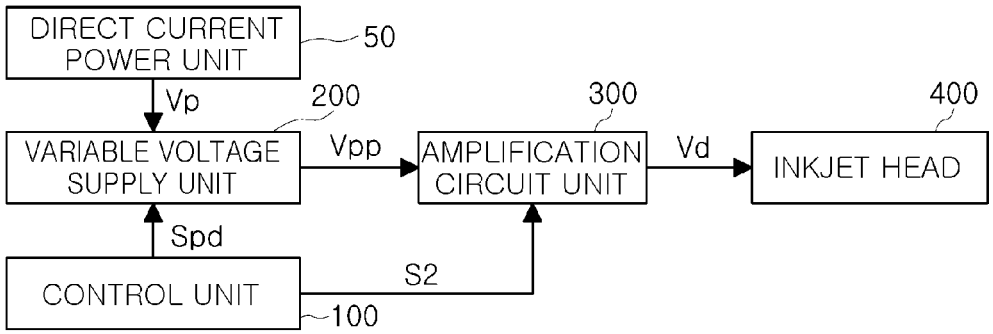
FIG. 1 is a block diagram of an apparatus for driving a multi-nozzle piezo inkjet head based on a digital grayscale according to an embodiment of the present invention.

Hereinafter, embodiments of the present invention will be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like elements.

FIG. 1 is a block diagram of an apparatus for driving a multi-nozzle piezo inkjet head 400 based on a digital grayscale according to an embodiment of the present invention.

Referring to FIG. 1, the apparatus for driving the multi-nozzle piezo inkjet head based on the digital grayscale according to an embodiment of the present invention may include a control unit 100 that provides a pulse data signal Spd having at least one pulse waveform according to graphic image data, controls a voltage variation according to a frequency response characteristic of the multi-nozzle piezo inkjet head 400, and controls a voltage amplification, so as to eject droplets of ink at a previously set jetting frequency according to the graphic image data; a variable voltage supply unit 200 that generates a varied operating voltage Vpp by varying a level of the previously set direct current voltage according to the pulse data signal of the control unit 100; and an amplification circuit unit 300 that generates a voltage driving waveform Vd including at least one pulse waveform having the level of the varied operating voltage Vpp according to the voltage amplification control of the control unit 100, and supplies the voltage driving waveform Vd to the multi-nozzle piezo inkjet head 400. In this regard, an amplification rate of the amplification circuit unit 300 may be "1".

In this case, the control unit 100 may provide the pulse data signal Spd having at least one pulse waveform according to the graphic image data, control the voltage variation of the variable voltage supply unit 200 according to the frequency response characteristic of the multi-nozzle piezo inkjet head 400, and control the voltage amplification of the amplification circuit unit 300, so as to eject droplets of ink at a previously set jetting frequency (for example, 150 kHz) according to the graphic image data.

The variable voltage supply unit 200 may receive a direct current voltage Vp from a direct current power unit 50 to thus operate, vary a level of a previously set direct current voltage and generate the varied operating voltage Vpp according to a pulse data signal of the control unit 100.

In this regard, although the varied operating voltage Vpp may include a single voltage level, in a case in which the varied operating voltage Vpp includes at least two voltage levels, the two voltage levels may be present when the level of the direct current voltage varies according to the pulse data signal of the control unit 100.

For example, in a case in which the varied operating voltage Vpp includes one voltage level, the voltage level may be 99V, and, in a case in which the varied operating voltage Vpp includes three voltage levels, these voltage levels may be 99V, 60V, and 150V.

The amplification circuit unit 300 may generate the voltage driving waveform Vd (for example, 99V) including at least one pulse waveform having a level of the varied operating voltage Vpp (for example, 99V) according to the voltage amplification control of the control unit 100, and may supply the voltage driving waveform Vd to the multi-nozzle piezo inkjet head 400.

For example, in a case in which the voltage driving waveform Vd includes a single pulse waveform, a level of the pulse waveform may be 99V, and the voltage driving waveform Vd includes three pulse waveforms, levels of these pulse waveforms may be 99V, 60V, and 150V.

Referring to FIG. 1, the voltage driving waveform Vd of the amplification circuit unit 300 may include a pulse waveform having an amplified voltage level (for example, 99V) that is amplified from a voltage level (for example, 3.3V) of the varied operating voltage Vpp.

Also, the voltage driving waveform Vd of the amplification circuit unit 300 may include at least two pulse waveforms having different voltage levels according to a voltage level of the varied operating voltage Vpp.

For example, in a case in which the voltage driving waveform Vd includes two pulse waveforms, levels of these pulse waveforms may be 99V and 60V, and, in a case in which the voltage driving waveform Vd includes three pulse waveforms, levels of these pulse waveforms may be 99V, 60V, and 150V.

In this case, the voltage level of the voltage driving waveform Vd of the control unit 100 may correspond to the voltage level of the varied operating voltage Vpp. For example, as described above, when the voltage level of the varied operating voltage Vpp is 99V, the voltage level of the varied operating voltage Vpp may be 99V.

Also, in a case in which the voltage driving waveform Vd of the amplification circuit unit 300 includes at least two pulse waveforms, the varied operating voltage Vpp may include at least two voltage levels. In this regard, when the voltage level of the varied operating voltage Vpp is differently varied (for example, 99V, 60V, and 150V), the voltage level of the voltage driving waveform Vd of the amplification circuit unit 300 may be differently varied (for example, 99V, 60V, and 150V).

Figure 2:
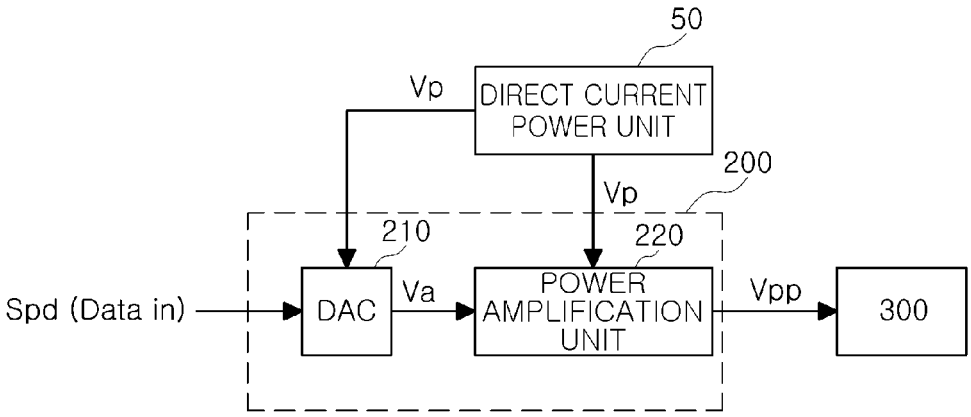
FIG. 2 is a view of an embodiment of a variable voltage supply unit of FIG. 1.

FIG. 2 is a view of an embodiment of the variable voltage supply unit 200 of FIG. 1.

Referring to FIG. 2, the variable voltage supply unit 200 may include a DAC 210 that converts the pulse data signal Spd of the control unit 100 into an analog voltage signal Va, and a power amplification unit 220 that generates the varied operating voltage Vpp by varying a previously set direct current voltage according to the analog voltage signal Va of the DAC 210.

In this case, the DAC 210 of the variable voltage supply unit 200 may convert the pulse data signal Spd of the control unit 100 into the analog voltage signal Va.

Also, the power amplification unit 220 may generate the varied operating voltage Vpp by varying the previously set direct current voltage according to the analog voltage signal Va of the DAC 210.

As described above, since the pulse data signal Spd is a digital signal in the embodiment of the present invention, a level of a pulse waveform within the voltage driving waveform Vd may be varied in a digital manner.

Meanwhile, a jetting frequency according to an embodiment of the present invention may be set higher than an operating frequency of the multi-nozzle piezo inkjet head 400 such that the jetting frequency may correspond to the grayscale.

For example, although the multi-nozzle piezo inkjet head 400 may operate at a low operating frequency like 30 kHz, the jetting frequency may be a frequency (for example, 150 kHz) of 100 kHz or more. In this case, even in a case in which the pulse data signal Spd includes a plurality of pulses having the jetting frequency, droplets ejected by the plurality of pulses may be ejected as a final one droplet. Such a description may be applied to each embodiment of the present invention.

Hereinafter, a method for driving a multi-nozzle piezo inkjet head based on a digital grayscale according to an embodiment of the present invention will now be described.

Figure 3:
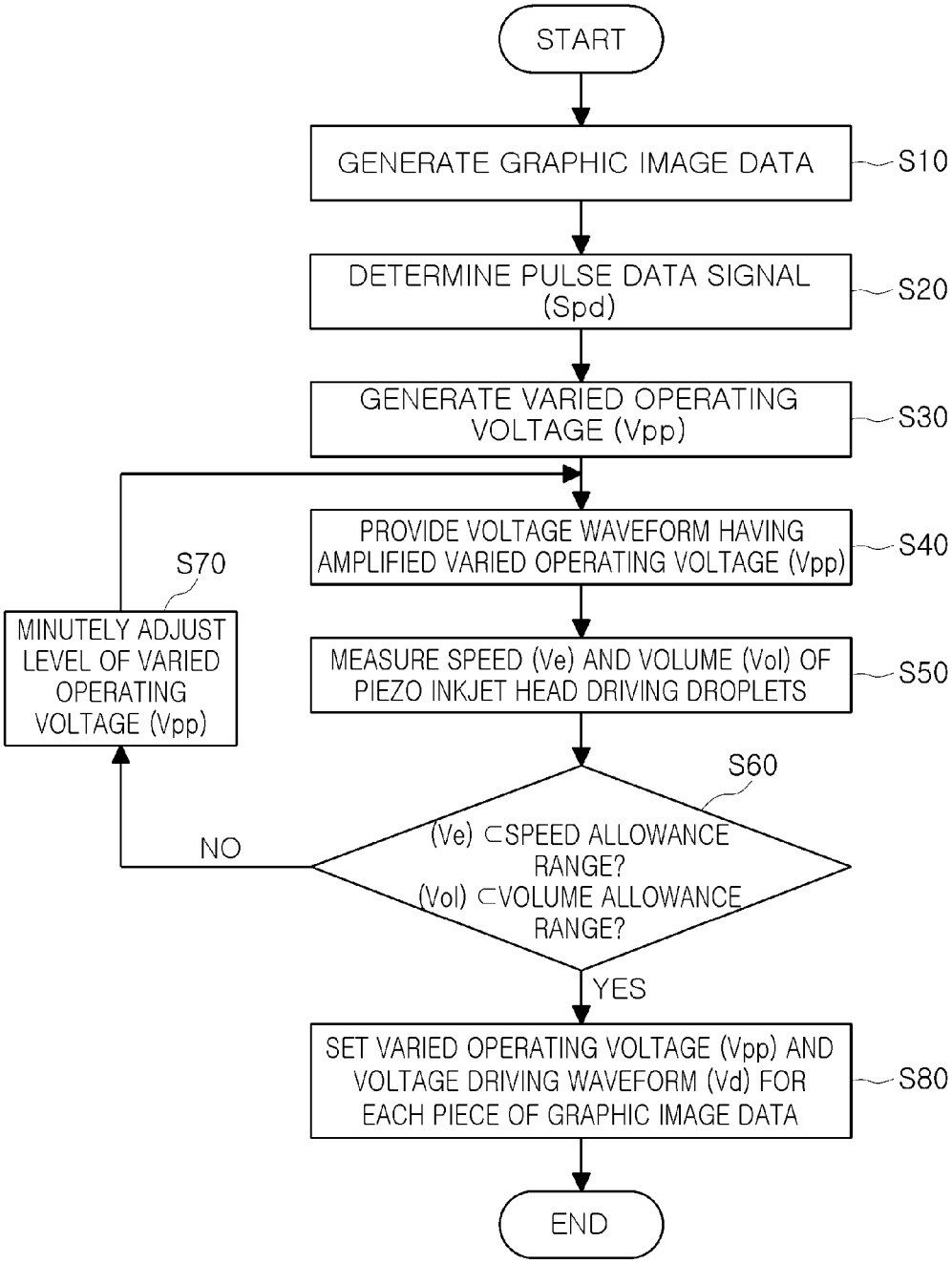
FIG. 3 is an initial setting flowchart of a method of driving a multi-nozzle piezo inkjet head based on a digital grayscale according to an embodiment of the present invention.

FIG. 3 is an initial setting flowchart illustrating a method of driving a multi-nozzle piezo inkjet head based on a digital grayscale according to an embodiment of the present invention.

Referring to FIG. 3, in the initial setting flowchart illustrating the method of driving the multi-nozzle piezo inkjet head based on the digital grayscale according to an embodiment of the present invention, the method may include an operation (S10) of (a), so as to eject droplets of ink at a previously set jetting frequency according to graphic image data, forming multi-channel image data according to an image to be printed; an operation (S20) of (b) previously setting a basic waveform having a plurality of pulse rows, and determining a pulse data signal having at least one pulse waveform according to the multi-channel image data for each of a plurality of nozzles of the multi-nozzle piezo inkjet head 400; an operation (S30) of (c) generating a varied operating voltage by varying a level of a previously set direct current voltage according to the pulse data signal according to a frequency response characteristic of the multi-nozzle piezo inkjet head 400; an operation (S40) of (d) generating a voltage waveform having at least one pulse waveform having a level of the varied operating voltage; an operation (S50) of (e) driving the multi-nozzle piezo inkjet head 400 by using the voltage waveform, and measuring a speed Ve and volume Vol of grayscale droplets; an operation (S60) of (f) determining whether the measured speed Ve and volume Vol are within previously set allowable ranges, an operation (S70) of (g), when the measured speed Ve and volume Vol are not within previously set allowable ranges, minutely adjusting the level of the varied operating voltage and proceeding to operation (d), and an operation (S80) of (h), when the measured speed Ve and volume Vol are within previously set allowable ranges, setting a varied operating voltage and a voltage driving waveform for respective pieces of graphic image data.

In this case, in operation (a), the multi-channel image data according to the image to be printed may be formed so as to eject droplets of ink at a previously set jetting frequency (for example, 150 kHz) according to the graphic image data (S10).

In operation (b), the basic waveform having the plurality of pulse rows is previously set, and the pulse data signal Spd having at least one pulse waveform according to the multi-channel image data may be determined for each of the plurality of nozzles of the multi-nozzle piezo inkjet head 400 (S20).

In operation (c), the varied operating voltage Vpp may be generated by varying the level of the previously set direct current voltage according to the pulse data signal Spd according to the frequency response characteristic of the multi-nozzle piezo inkjet head 400 (S30).

In operation (d), the voltage waveform Vd (for example, 100V) having at least one pulse waveform having the level of the varied operating voltage Vpp (for example, 99V) may be generated (S40).

In operation (e), the speed Ve and volume Vol of grayscale droplets may be measured by driving the multi-nozzle piezo inkjet head 400 by using the voltage waveform (S50).

In operation (f), it may be determined whether the measured speed Ve and volume Vol are within previously set allowable ranges (S60).

In operation (g), when the measured speed Ve and volume Vol are not within previously set allowable ranges, operation (d) may proceed after minutely adjusting the level of the varied operating voltage (S70).

In operation (h), when the measured speed Ve and volume Vol are within previously set allowable ranges, the varied operating voltage and the voltage driving waveform for respective pieces of graphic image data may be set (S80).

Referring to FIG. 3, operation (f) (S60) may include an operation of determining whether a difference between the measured droplet speed Ve and a target droplet speed is within a previously set allowable speed range, and an operation of determining whether a difference between the measured droplet volume Vol and a target droplet volume is within a previously set allowable volume range.

In this case, in operation (f) (S60), it may be determined whether the difference between the measured droplet speed Ve and the target droplet speed is within the previously set allowable speed range. Also, it may be determined whether the difference between the measured droplet volume Vol and the target droplet volume is within the previously set allowable volume range.

Through the above-described process, when the varied operating voltage and the driving voltage waveform based on the grayscale capable of generating droplets having sizes corresponding to respective pieces of graphic image data are set, the determined varied operating voltage and driving voltage waveform may be applied as follows, so as to drive nozzles of an inkjet head when the graphic image is actually printed.

Figure 4:
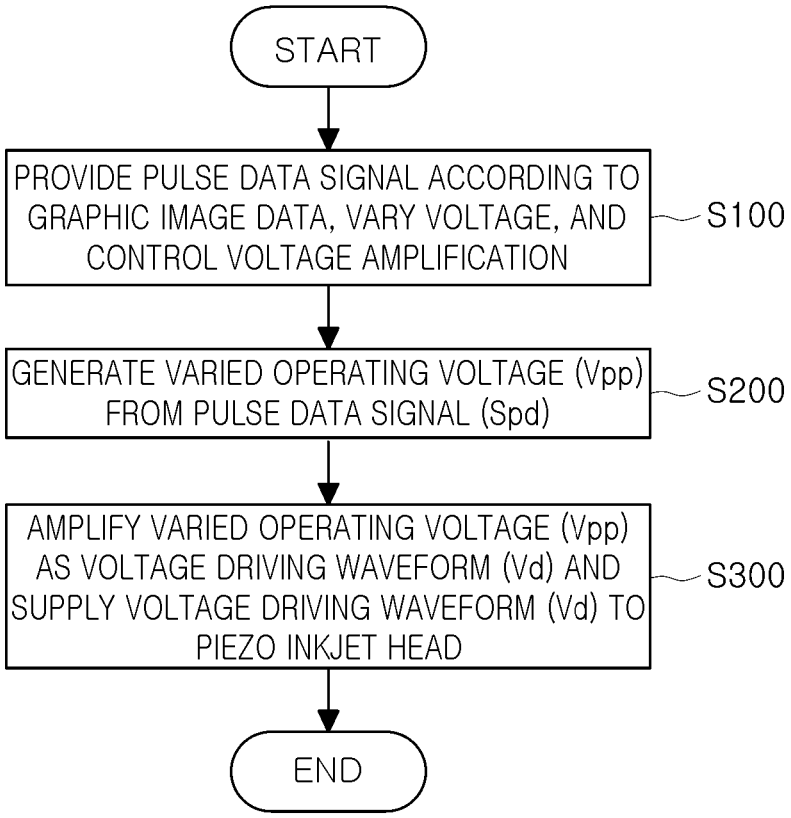
FIG. 4 is a flowchart illustrating a method of driving a multi-nozzle piezo inkjet head based on a digital grayscale according to an embodiment of the present invention.

FIG. 4 is a flowchart illustrating a method of driving a multi-nozzle piezo inkjet head based on a digital grayscale according to an embodiment of the present invention.

Referring to FIG. 4, the method of driving the multi-nozzle piezo inkjet head 400 based on the digital grayscale according to an embodiment of the present invention may include an operation (S100) of (i1) providing a pulse data signal according to graphic image data, controlling a voltage variation according to a frequency response characteristic of the multi-nozzle piezo inkjet head 400, and controlling a voltage amplification, so as to eject droplets of ink at a previously set jetting frequency according to the graphic image data; an operation (S200) of (i2) generating the varied operating voltage Vpp by varying a level of a previously set direct current voltage according to the pulse data signal of operation (i1); and an operation (S300) of (i3) generating the voltage driving waveform Vd including at least one pulse waveform having a level of the varied operating voltage Vpp of operation (i2) and supplying the voltage driving waveform Vd to the multi-nozzle piezo inkjet head 400.

In this case, in operation (i1), the pulse data signal Spd according to the graphic image data may be provided, the voltage variation may be controlled according to the frequency response characteristic of the multi-nozzle piezo inkjet head 400, and the voltage amplification may be controlled, so as to eject droplets of ink at the previously set jetting frequency according to the graphic image data (S100). In this regard, the multi-nozzle piezo inkjet head 400 has the frequency response characteristic in which an ejection speed differs according to a frequency, to be described below.

In operation (i2), the level (for example, 3.3V) of the previously set direct current voltage may be varied according to the pulse data signal of operation (i1), and the varied operating voltage Vpp having the varied level as described above (for example, 99V, 60V, 150V, etc.) may be generated (S200).

In operation (i3), as a process of amplifying a voltage level to a voltage level (for example, 100V) necessary for piezo driving, with respect to the varied operating voltage vpp of the operation (i2), the voltage driving waveform Vd having the previously set corresponding level (for example, 99V, 60V, 150V, etc.) may be generated and the amplified voltage driving waveform Vd may be supplied to the multi-nozzle piezo inkjet head 400 (S300).

Referring to FIG. 4, the voltage driving waveform Vd of operation (i3) (S300) may include at least one pulse waveform having a voltage level of the varied operating voltage Vpp of operation (i2) (S200). The voltage driving waveform Vd of operation (i3) (S300) may include at least two pulse waveforms having different voltage levels according to the voltage level of the varied operating voltage Vpp of operation (i2) (S200).

In this case, when the voltage driving waveform Vd of operation (i3) (S300) includes at least one pulse waveform, the pulse waveform may have a voltage level (for example, 99V) corresponding to the voltage level (for example, 99V) of the varied operating voltage Vpp of operation (i2) (S200).

When the voltage driving waveform Vd of operation (i3) (S300) includes at least two pulse waveforms, the at least two pulse waveforms may have different voltage levels (for example, 99V and 60V or 99V, 60V, 150V, etc.) according to the voltage level of the varied operating voltage Vpp of operation (i2) (S200).

The following descriptions with reference to FIGS. 5 through 10 will be applied to each embodiment of the present invention.

Figure 5:
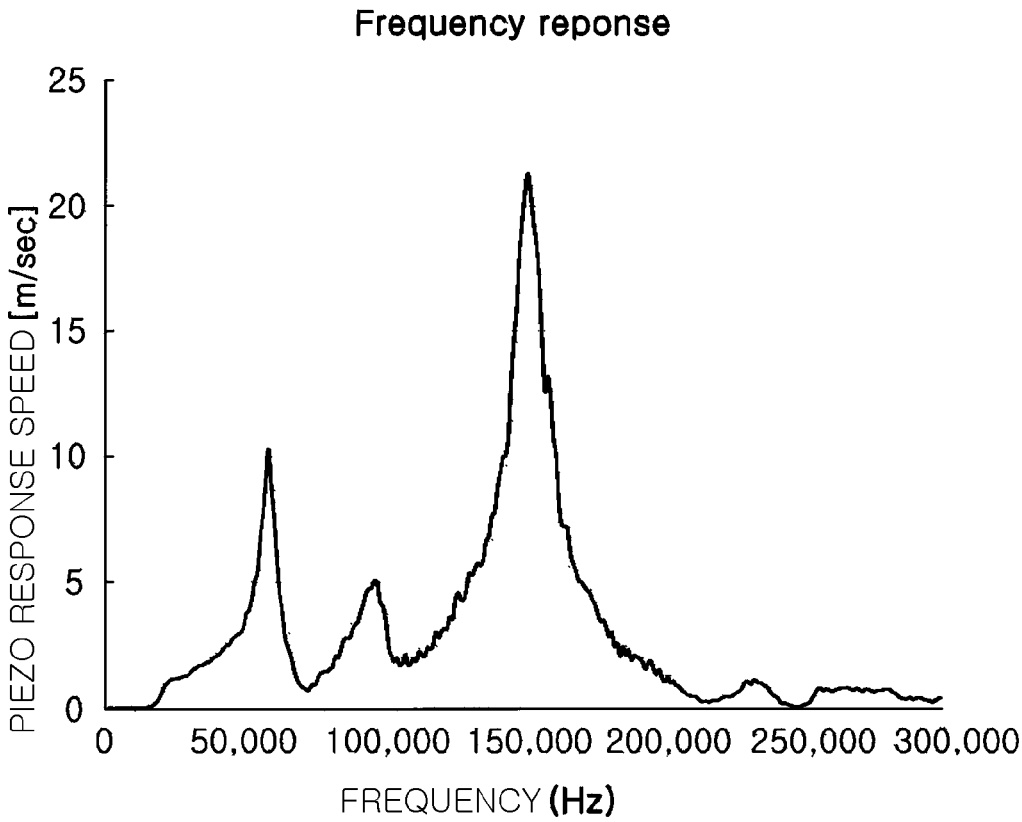
FIG. 5 is a graph of a frequency response characteristic of a multi-nozzle piezo inkjet head based on a digital grayscale according to an embodiment of the present invention.

FIG. 5 is a graph of a frequency response characteristic of the multi-nozzle piezo inkjet head 400 based on a digital grayscale according to an embodiment of the present invention.

Referring to the frequency response characteristic shown in FIGS. 1 through 5, a piezoelectric actuator has different ejection speeds according to an ejection frequency, which means that droplets may be provided at a fast speed according to the ejection frequency at a relatively low voltage, and thus a voltage may be applied to the multi-nozzle piezo inkjet head 400 by lowering a voltage level of a pulse waveform to be lower than a basic value of the pulse waveform.

However, since a second droplet must be generated to have a faster speed than a first droplet in order to combine the first droplet and the second droplet, until a speed and volume of a finally combined droplet is within a desired value range, final varied pulse data signal and pulse voltage signal may be generated by repeating the initial setting process of FIG. 5.

For example, as shown in FIG. 5, in a case in which the pulse data signal Spd includes three pulse waveforms, since the multi-nozzle piezo inkjet head 400 according to the embodiment of the present invention is based on the digital grayscale, the droplets are generated and combined with each other, and thus have a speed and volume of a single final droplet.

As shown in FIG. 3, the pulse data signal determined during the initial setting process may include three pulse waveforms in four grayscales, and may include seven pulse waveforms in eight grayscales. In this regard, in the case of one pulse waveform, a voltage of one waveform corresponding to the pulse waveform may be adjusted.

For another example, in a case in which the pulse data signals have two pulse waveforms, when a frequency range formed by a first pulse waveform and a second pulse waveform is 150 KHz, the frequency response characteristic of the multi-nozzle piezo inkjet head 400 may be the same as shown in FIG. 5. Also, in a case in which a frequency between two pulses is 150 KHz in the frequency response characteristic of the multi-nozzle piezo inkjet head 400, a response speed of the piezoelectric actuator may have a relatively highest peak.

Figure 6:
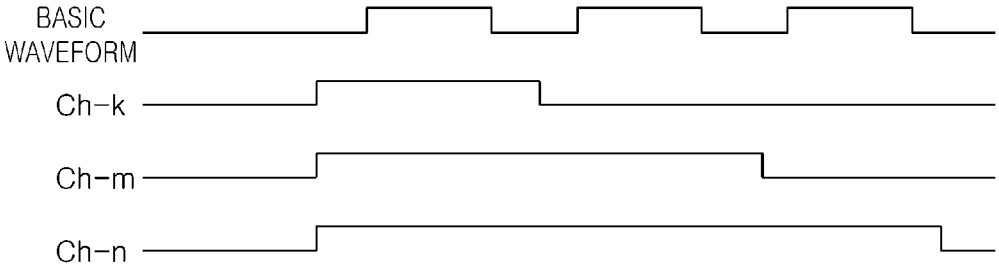
FIG. 6 is a view of a basic waveform and image data according to an embodiment of the present invention.

FIG. 6 is a view of a basic waveform and image data according to an embodiment of the present invention.

Referring to FIG. 6, the basic waveform may include continuously repetitive pulse waveforms. A pulse number may be selected for each channel according to graphic image data among the basic waveform.

For example, k, m, and n channel enable signals ch-k, ch-m, and ch-n may be determined according to the graphic image data.

Meanwhile, since each channel enable signal is determined according to the graphic image data necessary for printing, a size of a droplet that should be ejected from each nozzle at a specific time by the channel enable signal may be finally determined.

Figure 7:
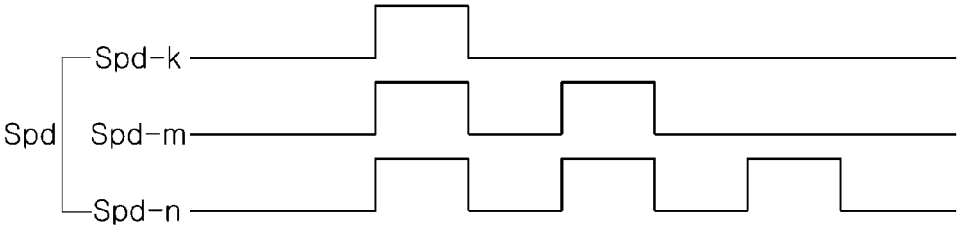
FIG. 7 is a view of pulse data signals according to an embodiment of the present invention.

FIG. 7 is a view of pulse data signals according to an embodiment of the present invention.

Referring to FIGS. 6 and 7, for example, it is assumed that in a nozzle enable signal ch-k of a k channel, one droplet must be ejected, in a nozzle enable signal ch-m of an m channel, two droplets must be ejected, in a nozzle enable signal ch-n of an n channel, three droplets must be ejected, and in a nozzle enable signal ch-m of an m channel, three droplets must be ejected; since the nozzle enable signal ch-k of the k channel requires one waveform, a pulse data signal Spd-k having one pulse may be generated by selecting one waveform section in which a waveform is enabled such as the nozzle enable signal ch-k of the k channel.

Since the nozzle enable signal ch-m of the m channel requires two waveforms, a pulse data signal Spd-m having two pulses may be generated by selecting two waveform sections in which a waveform is enabled such as the nozzle enable signal ch-m of the m channel.

Since the nozzle enable signal ch-n of the n channel requires three waveforms, a pulse data signal Spd-n having three pulses may be generated by selecting three waveform sections in which a waveform is enabled such as the nozzle enable signal ch-n of the n channel.

Figure 8:
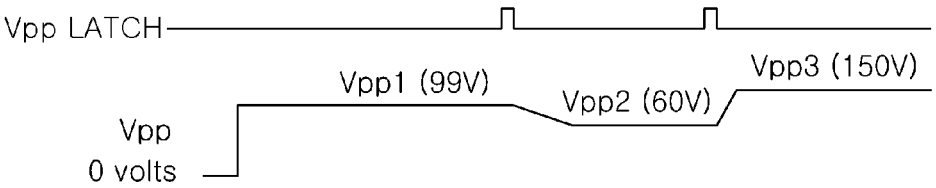
FIG. 8 is a view of a Vpp latch and a Vpp variable voltage according to an embodiment of the present invention.

FIG. 8 is a view of a Vpp latch and a Vpp variable voltage according to an embodiment of the present invention.

Referring to FIG. 8, to generate the varied operating voltage Vpp of the variable voltage supply unit 200, timing for changing Vpp, a time when the Vpp latch is supplied, and the Vpp variable voltage are shown. Regarding Vpp, for example, Vpp1 may be 99V, Vpp2 may be 60V, and Vpp3 may be 150V.

For example, as described above, since the pulse data signal Spd and voltage driving waveform Vd previously set for respective pieces of graphic image data are set, when graphic image data to be printed occurs, the pulse data signal Spd and the voltage driving waveform Vd corresponding to respective pieces of graphic image data are determined, and thus the operating voltage Vpp varied for each nozzle may be varied and maintained, and accordingly the voltage driving waveform may include a pulse waveform having a varied Vpp level.

Figure 9:
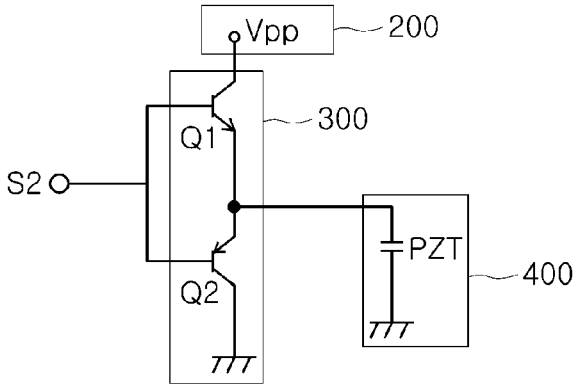
FIG. 9 is a view of a varied operating voltage according to an embodiment of the present invention.

FIG. 9 is a view of the varied operating voltage Vpp according to an embodiment of the present invention.

Referring to FIGS. 7, 8, and 9, in a case in which the amplification circuit unit 300 is configured as an inverter having an amplification rate of "1" and including first and second transistors Q1 and Q2 that complementarily operate on/off at the same signal level (a high level or a low level), when the first transistor Q1 is turned on, and the second transistor Q2 is turned off, the varied operating voltage Vpp may be supplied to the piezoelectric (PzT) actuator, whereas, when the first transistor Q1 is turned off, and the second transistor Q2 is turned on, a ground level 0V may be applied to the piezoelectric (PzT) actuator. In this regard, the first and second transistors Q1 and Q2 may be an NPN transistor and a PNP transistor as an example.

According to such operating of the amplification circuit unit 300, the voltage driving waveform having a pulse waveform including the level of the varied operating voltage Vpp and the ground level may be applied to the piezoelectric actuator.

Further, in this regard, the varied operating voltage Vpp may be varied as Vpp1 (99V), Vpp2 (60V), and Vpp3 (150V) as described above.

Figure 10:
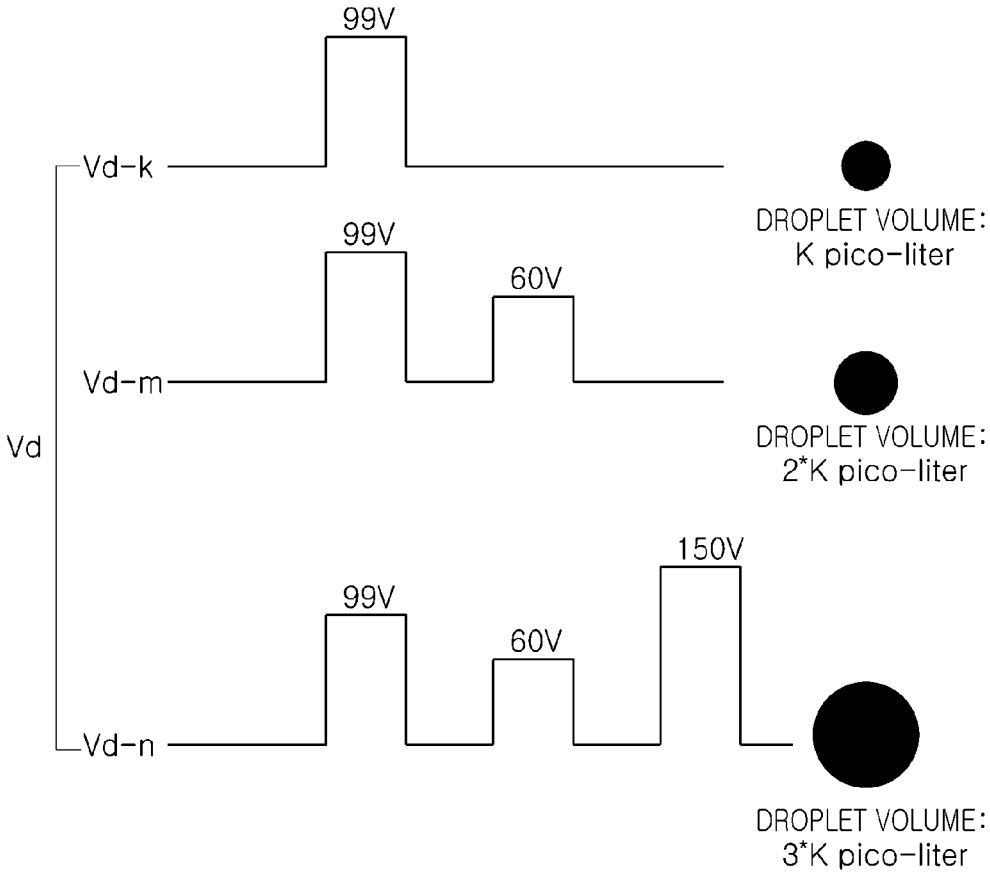
FIG. 10 is a view of a voltage driving waveform according to an embodiment of the present invention.

FIG. 10 is a view of the voltage driving waveform Vd according to an embodiment of the present invention.

Referring to FIGS. 9 and 10, for example, the voltage driving waveform Vd including a pulse waveform having levels 99V, 60V, and 150V to which the varied operating voltages Vpp 99V, 60V, and 150V are applied may be generated. The voltage driving waveform Vd may be applied to the piezoelectric actuator, and thus droplets having various sizes may be formed.

As set forth above, according to embodiments of the present invention, the speed and volume of droplets may be appropriately adjusted by varying a level of a voltage driving waveform according to digital data based on a digital grayscale, without increasing a slew rate of a voltage driving waveform when a multi-nozzle piezo inkjet head is driven.

While the present invention has been shown and described in connection with the embodiments, it will be apparent to those skilled in the art that modifications and variations can be made without departing from the spirit and scope of the invention as defined by the appended claims.

What is claimed is:

1. An apparatus for driving a multi-nozzle piezo-inkjet head based on a digital grayscale, the apparatus comprising:

a control unit providing a pulse data signal having at least one pulse waveform according to graphic image data, controlling a voltage variation according to a frequency response characteristic of the multi-nozzle piezo inkjet head, and controlling a voltage amplification, so as to eject droplets of ink at a previously set jetting frequency according to the graphic image data;

a variable voltage supply unit generating a varied operating voltage by varying a level of a previously set direct current voltage according to the pulse data signal of the control unit; and an amplification circuit unit generating a voltage driving waveform including at least one pulse waveform having the level of the varied operating voltage according to a voltage amplification control of the control unit, and supplying the voltage driving waveform to the multi-nozzle piezo inkjet head.

2. The apparatus of claim 1, wherein the voltage driving waveform of the amplification circuit unit includes a pulse waveform having a voltage level that is amplified from the voltage level of the varied operating voltage.

3. The apparatus of claim 2, wherein the voltage driving waveform of the amplification circuit unit includes at least two pulse waveforms having different voltage levels according to the voltage level of the varied operating voltage.

4. The apparatus of claim 1, wherein the variable voltage supply unit includes:

a DAC that converts the pulse data signal of the control unit into an analog voltage signal; and a power amplification unit that generates the varied operating voltage by varying the previously set direct current voltage according to the analog voltage signal of the DAC.

5. The apparatus of claim 1, wherein the jetting frequency is set higher than an operating frequency of the multi-nozzle piezo-inkjet head such that the jetting frequency corresponds to the grayscale.

6. A method of driving a multi-nozzle piezo inkjet head based on a digital grayscale, the method comprising:

(a) forming multi-channel image data according to an image to be printed, so as to eject droplets of ink at a previously set jetting frequency according to graphic image data;

(b) previously setting a basic waveform having a plurality of pulse rows, and determining a pulse data signal having at least one pulse waveform according to the multi-channel image data for each of a plurality of nozzles of the multi-nozzle piezo inkjet head;

(c) generating a varied operating voltage by varying a level of a previously set direct current voltage according to the pulse data signal according to a frequency response characteristic of the multi-nozzle piezo inkjet head;

(d) generating a voltage waveform having at least one pulse waveform having a level of the varied operating voltage;

(e) driving the multi-nozzle piezo inkjet head by using the voltage waveform, and measuring a speed and volume of the ejected grayscale droplets;

(f) determining whether the measured speed and volume of ejected grayscale droplets are within previously set allowable ranges;

(g) when the measured speed and volume of the ejected grayscale droplets are not within previously set allowable ranges, minutely adjusting the level of the varied operating voltage and proceeding to operation (d); and (h) when the measured speed and volume of the ejected grayscale droplets are within previously set allowable ranges, setting a varied operating voltage and a voltage driving waveform for respective pieces of graphic image data.

7. The method of claim 6, wherein the operation (f) includes:

determining whether a difference between the measured droplet speed and a target droplet speed is included in a previously set allowable speed range; and determining whether a difference between the measured droplet volume and a target droplet volume is within a previously set allowable volume range.

8. The method of claim 6, wherein the jetting frequency is set higher than an operating frequency of the multi-nozzle piezo-inkjet head such that the jetting frequency corresponds to the grayscale.

9. A method of driving a multi-nozzle piezo inkjet head based on a digital grayscale, the method comprising:

(i1) providing a pulse data signal according to graphic image data, controlling a voltage variation according to a frequency response characteristic of the multi-nozzle piezo inkjet head, and controlling a voltage amplification, so as to eject droplets of ink at a previously set jetting frequency according to the graphic image data;

(i2) generating a varied operating voltage by varying a level of a previously set direct current voltage according to the pulse data signal of operation (i1); and (i3) generating a voltage driving waveform including at least one pulse waveform having a level of the varied operating voltage of the operation (i2) and supplying the voltage driving waveform to the multi-nozzle piezo inkjet head.

10. The method of claim 9, wherein the voltage driving waveform of the operation (i3) has the voltage level of the operation (i2).

11. The method of claim 9, wherein the voltage driving waveform of the operation (i3) includes different voltage levels.

12. The method of claim 9, wherein the jetting frequency is set higher than an operating frequency of the multi-nozzle piezo-inkjet head such that the jetting frequency corresponds to the grayscale.

* * * * *